US010422200B2

(12) United States Patent
Budler

(10) Patent No.: US 10,422,200 B2
(45) Date of Patent: Sep. 24, 2019

(54) BREAKABLE BALL FOR WELLBORE OPERATIONS

(71) Applicant: Halliburton Energy Services, Inc., Houston, TX (US)

(72) Inventor: Nicholas F. Budler, Claremore, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/509,165

(22) PCT Filed: Oct. 17, 2014

(86) PCT No.: PCT/US2014/061243

§ 371 (c)(1),
(2) Date: Mar. 6, 2017

(87) PCT Pub. No.: WO2016/060692

PCT Pub. Date: Apr. 21, 2016

(65) Prior Publication Data

US 2017/0247978 A1 Aug. 31, 2017

(51) Int. Cl.

| | |
|---|---|
| ***E21B 29/02*** | (2006.01) |
| ***E21B 34/06*** | (2006.01) |
| ***E21B 34/14*** | (2006.01) |
| ***E21B 29/00*** | (2006.01) |
| *E21B 43/00* | (2006.01) |

(Continued)

(52) U.S. Cl.

CPC ..... *E21B 34/063* (2013.01); *E21B 29/00* (2013.01); *E21B 29/02* (2013.01); *E21B 34/14* (2013.01); *E21B 43/00* (2013.01); *E21B 43/38* (2013.01); *E21B 2043/0115* (2013.01)

(58) Field of Classification Search

CPC ..... E21B 34/00; E21B 34/063

See application file for complete search history.

(56) References Cited

U.S. PATENT DOCUMENTS 2,651,368 A * 9/1953 Baker ..... E21B 34/14 137/70

5,941,309 A * 8/1999 Appleton ..... E21B 23/006 137/71

(Continued)

OTHER PUBLICATIONS

International Search Report and Written Opinion dated Jun. 30, 2015; International PCT Application No. PCT/US2014/061243.

(Continued)

*Primary Examiner* — David J Bagnell
*Assistant Examiner* — Dany E Akakpo
(74) *Attorney, Agent, or Firm* — McGuireWoods LLP

(57) ABSTRACT

A system for use in a wellbore that penetrates a subterranean formation, the system comprising: a wellbore; and a ball, wherein the ball performs one or more wellbore operations, and wherein the ball breaks apart into two or more pieces when a pressure is applied to the ball. A method of performing an operation in a wellbore, the method comprising: introducing a ball into the wellbore; causing or allowing the ball to perform at least one wellbore operation; and causing the ball to break into two or more pieces after performing the at least one wellbore operation. The ball can also perform more than one wellbore operation. The ball can also contain a core.

23 Claims, 4 Drawing Sheets

(51) Int. Cl.
*E21B 43/38* (2006.01)
*E21B 43/01* (2006.01)

(56) References Cited

U.S. PATENT DOCUMENTS

| | | | | |
|---|---|---|---|---|
| 7,168,494 | B2 | 1/2007 | Starr et al. | |
| 8,127,856 | B1 | 3/2012 | Nish et al. | |
| 8,528,633 | B2 * | 9/2013 | Agrawal | E21B 23/04 166/153 |
| 2011/0132620 | A1 | 6/2011 | Agrawal | |
| 2011/0132621 | A1 | 6/2011 | Agrawal | |
| 2011/0186306 | A1 * | 8/2011 | Marya | E21B 33/12 166/386 |
| 2012/0067595 | A1 * | 3/2012 | Noske | E21B 23/02 166/373 |
| 2012/0181032 | A1 | 7/2012 | Naedler et al. | |
| 2012/0276356 | A1 * | 11/2012 | Xu | E21B 41/00 428/218 |
| 2013/0029886 | A1 | 1/2013 | Mazyar et al. | |
| 2013/0032357 | A1 | 2/2013 | Mazyar et al. | |
| 2013/0327540 | A1 | 12/2013 | Hamid et al. | |
| 2013/0333891 | A1 | 12/2013 | Fripp et al. | |
| 2014/0027128 | A1 | 1/2014 | Johnson et al. | |
| 2014/0174728 | A1 * | 6/2014 | Speer | E21B 23/04 166/250.01 |
| 2015/0159462 | A1 * | 6/2015 | Cutler | E21B 33/12 166/377 |

OTHER PUBLICATIONS

Great Britain Examination Report dated Oct. 16, 2017; Great Britain Application No. GB1702420.9.

* cited by examiner

BREAKABLE BALL FOR WELLBORE OPERATIONS

TECHNICAL FIELD

Balls can be used to provide zonal isolation by creating one or more wellbore intervals. Balls can also be used to shift sliding sleeves to open or close ports located in a wellbore. Balls can also be removed after their intended use is no longer desired. A breakable ball can be used in oil and gas operations.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
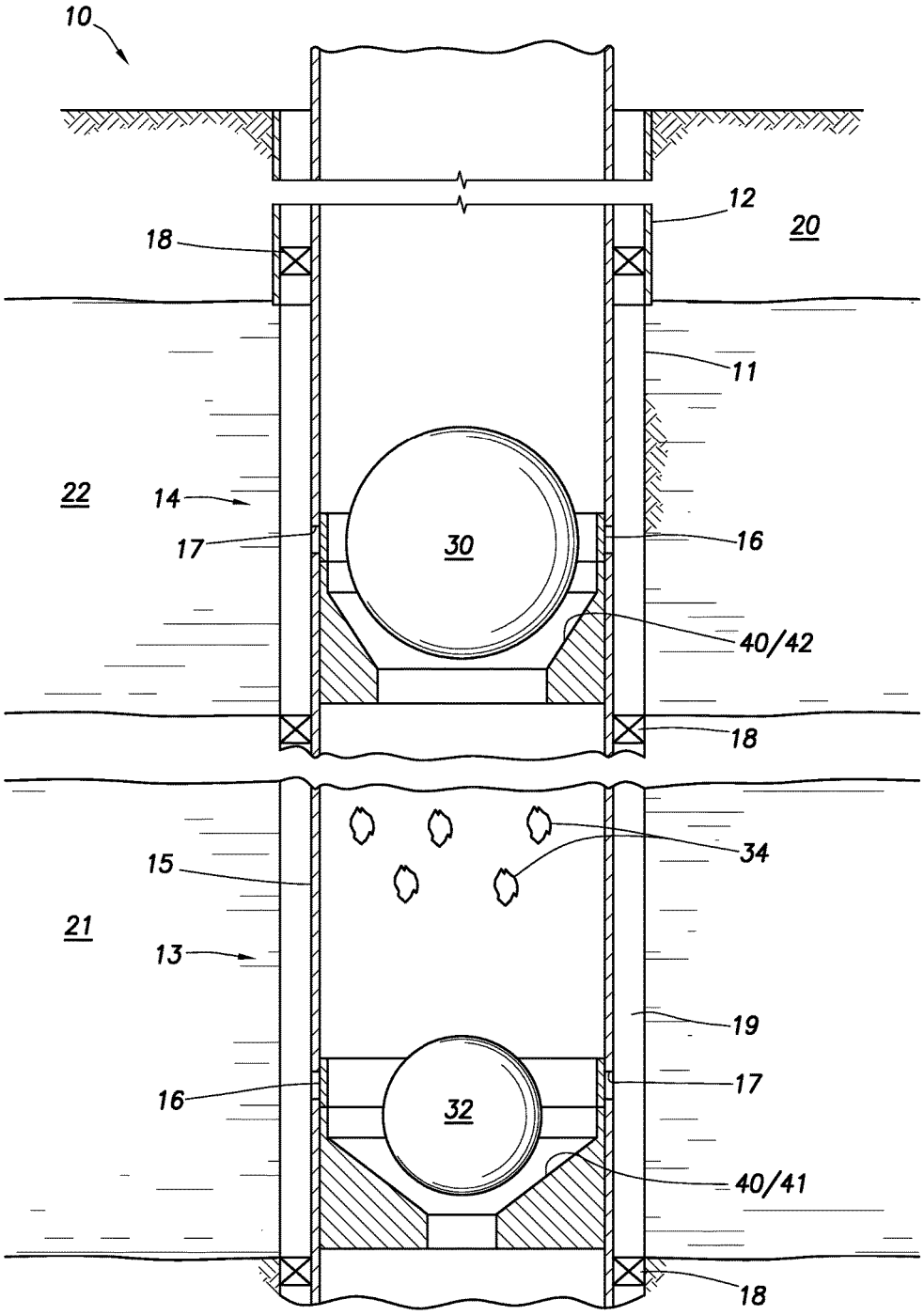
FIG. 1 is a cross-sectional illustration of a well system containing a ball with a breakable outer shell and core.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device to create multiple wellbore intervals. At least one wellbore interval corresponds to a formation zone. The isolation device can be used for zonal isolation and functions to block fluid flow within a tubular, such as a tubing string, or within an annulus. The blockage of fluid flow prevents the fluid from flowing across the isolation device in any direction and isolates the zone of interest. In this manner, treatment techniques can be performed within the zone of interest.

Common isolation devices include, but are not limited to, a ball and a baffle, a bridge plug, a frac plug, a packer, a plug, and wiper plug. It is to be understood that reference to a "ball" is not meant to limit the geometric shape of the ball to spherical, but rather is meant to include any device that is capable of engaging with a baffle. A "ball" can be spherical in shape, but can also be a dart, a plug (free fall or displacement type), or any other shape. Zonal isolation can be accomplished via a ball and baffle by dropping or flowing the ball from the wellhead onto the baffle that is located within the wellbore. The ball engages with the baffle, and the seal created by this engagement prevents fluid communication into other wellbore intervals downstream of the ball and baffle. As used herein, the relative term "downstream" means at a location further away from a wellhead. In order to treat more than one zone using a ball and baffle, the wellbore can contain more than one ball baffle. For example, a baffle can be located within each wellbore interval. Generally, the inner diameter (I.D.) of the ball baffles is different for each zone. For example, the I.D. of the ball baffles sequentially decreases at each zone, moving from the wellhead to the bottom of the well. In this manner, a smaller ball is first dropped into a first wellbore interval that is the farthest downstream; the corresponding zone is treated; a slightly larger ball is then dropped into another wellbore interval that is located upstream of the first wellbore interval; that corresponding zone is then treated; and the process continues in this fashion—moving upstream along the wellbore—until all the desired zones have been treated. As used herein, the relative term "upstream" means at a location closer to the wellhead.

It should be understood that, as used herein, "first," "second," "third," etc., are arbitrarily assigned and are merely intended to differentiate between two or more pieces, wellbore intervals, etc., as the case may be, and does not indicate any particular orientation or sequence. Furthermore, it is to be understood that the mere use of the term "first" does not require that there be any "second," and the mere use of the term "second" does not require that there be any "third," etc.

A bridge plug and frac plug are composed primarily of slips, a plug mandrel, and a rubber sealing element. The bridge plug or frac plug can be introduced into a wellbore and the sealing element along with a ball can be caused to block fluid flow into downstream intervals. Some tools, such as plugs, can contain a rupture disk. The tool can be positioned in the tubing string to provide zonal isolation. Then, when it is desirable, a higher pressure can be exerted on the rupture disk to break or rupture the disk. Once the disk is ruptured, fluid flow can be restored between the wellbore intervals. This allows other wellbore operations, such as cementing operations, to be performed.

However even though fluid flow is restored, the flow area can be substantially reduced compared to the flow area of the tubing string. This is because the diameter of the space where the rupture disk used to be is generally a lot less than the inner diameter of the tubing string.

Thus, there is a need for improved devices that can be used to provide temporary zonal isolation and function to shift a sleeve while restoring as large a flow area as possible after use is no longer needed. It has been discovered that a ball can be used to perform at least one operation before breaking into two or more pieces. The ball can also perform an additional operation after breaking. The operations can be providing zonal isolation and tripping a sleeve of a sliding sleeve assembly.

According to an embodiment, a system for use in a wellbore that penetrates a subterranean formation, the system comprising: a wellbore; and a ball, wherein the ball performs one or more wellbore operations, and wherein the ball breaks apart into two or more pieces when a pressure is applied to the ball.

According to another embodiment, a method of performing an operation in a wellbore, the method comprising: introducing a ball into the wellbore; causing or allowing the ball to perform at least one wellbore operation; and causing the ball to break into two or more pieces after performing the at least one wellbore operation.

Any discussion of the embodiments regarding the ball or any component related to the ball (e.g., the core) is intended to apply to all of the apparatus, system, and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A tubing string 15 can be installed in the wellbore 11. The well system 10 can comprise at least a first wellbore interval 13 and a second wellbore interval 14. The well system 10 can also include more than two wellbore intervals, for example, the well system 10 can further include a third wellbore interval, a fourth wellbore interval, and so on. At least one wellbore interval can correspond to a specific zone of the subterranean formation 20. For example, the subterranean formation 20 can include a first zone 21 and a second zone 22. The subterranean formation 20 can also include more than two zones, for example, a third zone, a fourth zone, and so on. The well system 10 can further include one or more packers 18. The packers 18 can be used to help create the wellbore intervals and isolate each zone of the subterranean formation 20. The packers 18 can be used to prevent fluid flow between one or more wellbore intervals (e.g., between the first wellbore interval 13 and the second wellbore interval 14) via an annulus 19.

Figure 2:
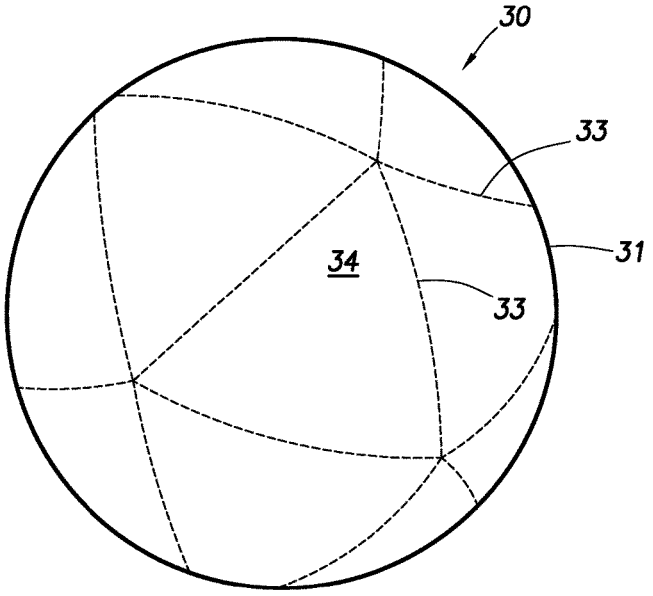
FIG. 2 is a cross-sectional illustration of a breakable outer shell according to certain embodiments.
Figure 3:
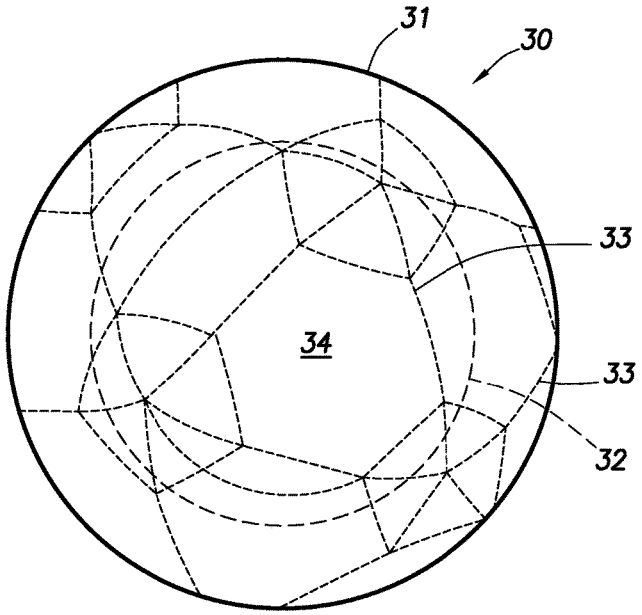
FIG. 3 is a cross-sectional illustration of a breakable outer shell according to other embodiments and the ball containing a core.

The well system 10 also includes a ball 30. FIGS. 2 and 3 illustrate the ball 30 according to certain embodiments. The ball 30 can include a shell 31. The shell 31 can be made from a variety of materials, such as metals and metal alloys, composites, phenolics, plastics, and wood. The material making up the shell 31 as well as the thickness of the shell can be selected such that the ball 30 has a desired density. The desired density can be a density greater than or equal to the density of a wellbore fluid used to introduce the ball into the wellbore. Accordingly, the ball 30 will resist trying to float to the top of a column of wellbore fluid. For example, the ball 30 can have a density in the range of about 1 to about 8 grams per cubic centimeter ($g/cm^3$). The material can also be any material that can be perforated.

The shell 31 breaks into two or more pieces 34 when a pressure is applied to the ball 30. As used herein, the word "break" and all grammatical variations thereof means to cause to separate into discrete pieces or fragments. The shell 31 can include a plurality of perforations 33. The perforations 33 can be holes or slots that are machined, drilled, or molded into the shell 31 during the manufacturing process. The perforations 33 can be any pattern on the shell 31 to form the pieces 34. The resulting pieces 34 after the shell 31 breaks apart can be a variety of sizes and shapes, including but not limited to, circular, elliptical, square, rectangular, triangular, and polygonal (such as tetrahedral, pentagonal, octagonal, etc.). The perforations 33 can also be designed such that the pieces 34 have a desired cross-sectional area after breaking apart. For example, the pieces 34 may need to be large enough such that they do not impede wellbore operations by getting stuck in wellbore equipment and small enough to be flowed towards a wellhead of the wellbore. Accordingly, the pattern of the perforations 33 can be selected to provide the desired size and shape of the pieces 34. However, not all of the pieces 34 need to be the same size and shape and a variety of sizes and shapes could result after the shell breaks apart.

As shown in FIG. 3, the ball 30 can further include a core 32. The core 32 can be located inside of the shell 31. The core 32 can be liberated from the shell after the shell breaks into the two or more pieces 34.

Figure 4:
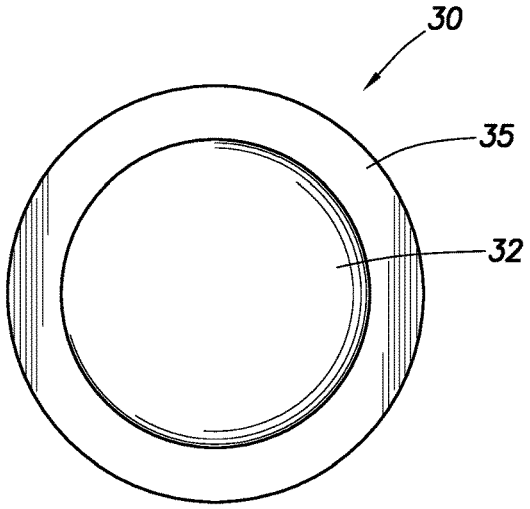
FIG. 4 is a cross-sectional illustration of a ball containing a breakable outer ring and core according to certain embodiments.
Figure 5:
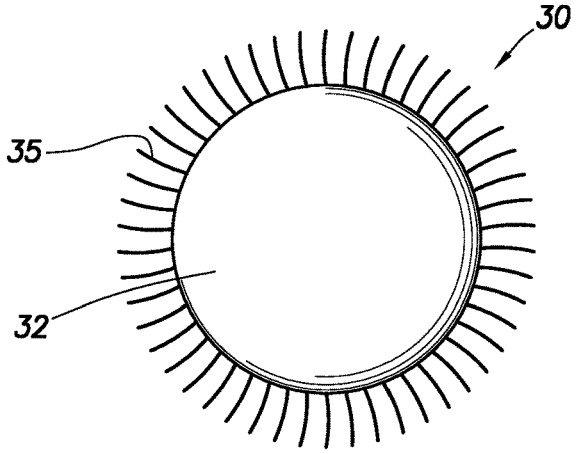
FIG. 5 is a cross-sectional illustration of a ball containing a breakable outer ring and core according to other embodiments.

FIGS. 4 and 5 depict the ball 30 according to other embodiments. As can be seen, the ball 30 can include the core 32. The core 32 (i.e., any core for use with a ball as depicted in FIG. 3, 4, or 5) can be made from a variety of materials, such as metals and metal alloys, composites, phenolics, plastics, and wood. The core 32 can be solid or hollow (i.e., an outer shell filled with air). The core 32 can also contain layers of different types of materials. The material making up the core 32 as well as the thickness of the outer shell of the core (if hollow) can be selected such that the core 32 has a desired density. The desired density can be a density greater than or equal to the density of the wellbore fluid. Accordingly, the core 32 will resist trying to float to the top of a column of wellbore fluid. For example, the core 32 can have a density in the range of about 1 to about 8 $g/cm^3$. The core 32 can also include perforations (not shown). In this manner, the core can break into two or more pieces to be flowed from the wellbore after performing a wellbore operation.

Still with reference to FIGS. 4 and 5, the ball 30 also includes an outer ring 35 connected to the core 32. The outer ring 35 can be a solid ring as depicted in FIG. 4 or whickers (fingerlike projections) as depicted in FIG. 5. The outer ring 35 can be connected to the core 32 in a variety of ways, such as spot-welding, adhesives, mechanical fasteners, or be manufactured from the core material itself through machining or molding operations. The core 32 breaks away from the outer ring 35 when a pressure is applied to the ball 30 to create two pieces. According to certain embodiments, the outer ring 35 is connected to the core 32 such that the two pieces break apart from each other when the pressure is applied to the ball 30. The outer ring 35 can be made from a variety of materials, such as metals and metal alloys, composites, phenolics, plastics, and wood.

The methods include introducing the ball 30 into the wellbore 11. The ball 30 can be dropped or flowed into the wellbore 11. The methods also include causing or allowing the ball 30 to perform at least one wellbore operation. The at least one wellbore operation can be selected from creating two wellbore intervals or sifting a sleeve. By way of example, with reference to FIGS. 1 and 6, the ball 30 can be introduced into the wellbore. The shell 31 of the ball 30 or the outer ring 35 can land on a baffle 40/42. This engagement with the baffle 40/42 can create a wellbore interval by blocking fluid flow past the ball 30 and baffle 40/42.

The tubing string 15 can include one or more ports 17. One or more ports 17 can be located in each wellbore interval. The ports 17 can be opened whereby fluid can flow through the port when a sliding sleeve 16 is shifted. The ball 30 (e.g., the shell 31 or the outer ring 35) can engage with the sliding sleeve 16 to open the port 17 to allow fluid flow. The ball can also cause the port to become closed by shifting of the sliding sleeve. It should be understood that while the discussion pertains to shifting of a sliding sleeve located adjacent to a baffle, the ball could be used to shift any sliding sleeve regardless of location, for example a sleeve that is part of a packer or other downhole tools.

Figure 6:
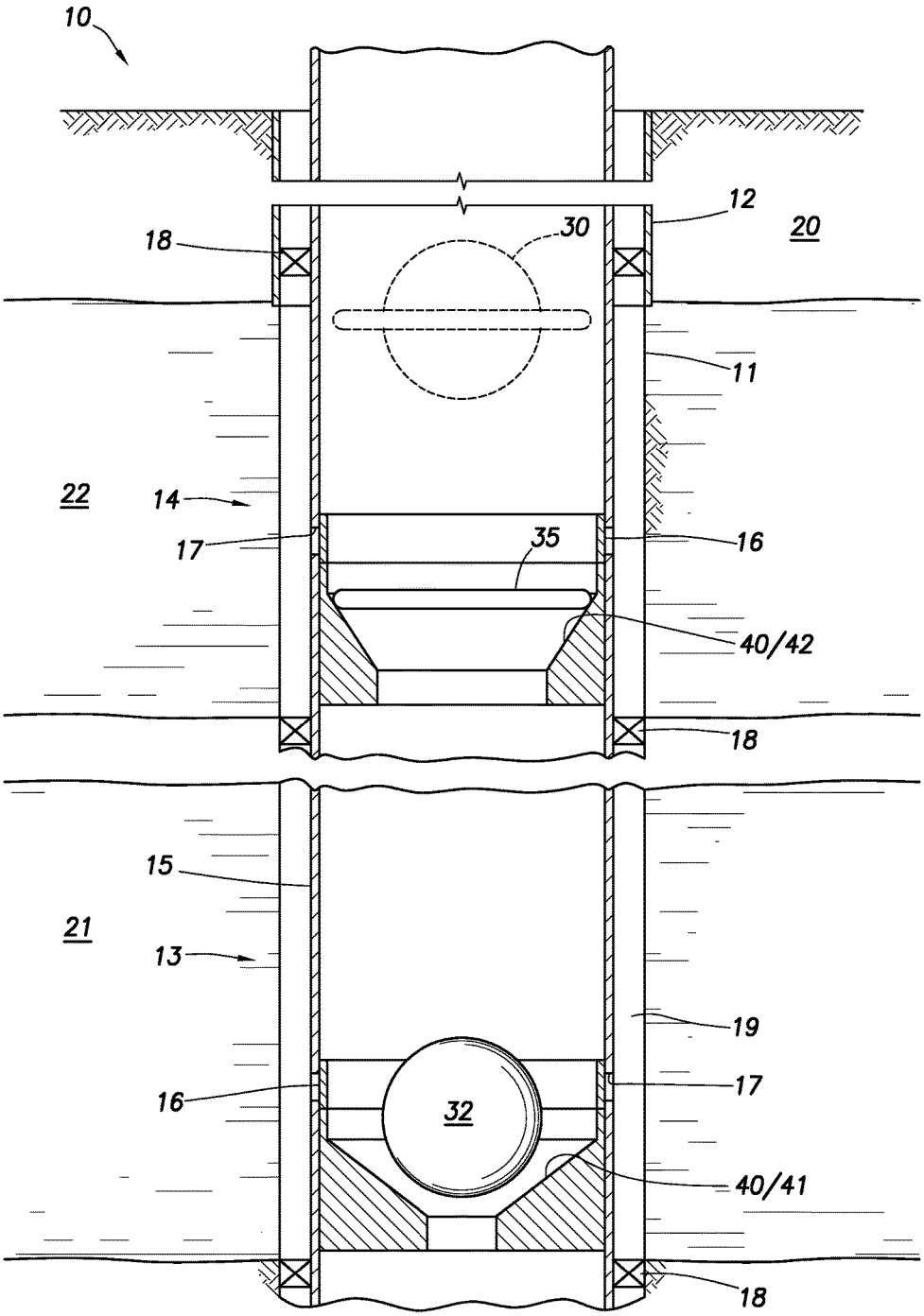
FIG. 6 is a cross-sectional illustration of a well system containing a ball according to FIG. 4 or 5.

The ball 30 breaks into two or more pieces after performing the at least one wellbore operation. For example, as depicted in FIG. 1, the shell 31 of the ball 30 can break into pieces 34 after landing on the baffle 40/42. The ball can also break into the two or more pieces after a desired amount of time has passed since the ball performed the at least one wellbore operation. The desired amount of time can be the time necessary to perform another operation, such as fracturing, gravel packing, or cementing. As depicted in FIG. 6, the ball 30 can break into the core 32 and outer ring 35 after landing on the baffle 40/42. According to certain embodiments, at least some of the pieces of the ball flow downstream after breaking of the ball. For example, the pieces 34 can flow downstream or the core 32 can flow downstream. Fluid flow between the wellbore intervals can also be restored after the ball breaks into the two or more pieces. In this manner, zonal isolation is no longer accomplished and the wellbore interval may no longer be created.

According to certain embodiments, the ball 30 breaks into the two or more pieces when a pressure is applied to the ball. The pressure can be predetermined. The pressure can be a pressure that is greater than an operational pressure, such as the pressure for fracturing the subterranean formation 20. In this manner, the ball can remain engaged with a baffle, the ports can be opened, and then a fracturing fluid can then be pumped downhole and out into the subterranean formation to create or enhance one or more fractures through the open ports. The predetermined pressure (being greater than the fracturing pressure) can then be applied to the ball to cause it to break into the two or more pieces.

The predetermined pressure can also be less than an operational pressure, such as for gravel packing or cementing operations. In this manner, the predetermined pressure can be applied to the ball to cause it to break into the two or more pieces, then the treatment fluid can be pumped downhole and can flow into an annulus or subterranean formation or other location in the wellbore via the open ports.

The ball 30 can also perform more than one wellbore operation. The second wellbore operation can be performed after the ball breaks into the two or more pieces. These embodiments are useful when the ball 30 also includes a core 32. As shown in FIGS. 1 and 6, the core 32 can flow downstream. The core 32 can then perform the second wellbore operation. The second wellbore operation can be creating a wellbore interval or shifting a sliding sleeve. For example, the core 32 can flow downstream and engage the baffle 40/41 to create the wellbore interval and/or shift the sliding sleeve 16 to open or close the ports 17. The core 32 can then either: remain in the wellbore, be milled out or removed, or be broken into pieces when a second pressure is applied to the core (e.g., when the core is perforated).

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

Therefore, the present system is well adapted to attain the ends and advantages mentioned as well as those that are inherent therein. The particular embodiments disclosed above are illustrative only, as the principles of the present disclosure can be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above can be altered or modified and all such variations are considered within the scope and spirit of the principles of the present disclosure.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that can be incorporated herein by reference, the definitions that are consistent with this specification should be adopted.

What is claimed is:

1. A method of performing an operation in a wellbore, the method comprising:

introducing a ball into the wellbore;

causing or allowing the ball to perform a first wellbore operation; and causing the ball to break into three or more pieces after performing the first wellbore operation;

wherein the ball comprises a shell having a pattern on a surface of the shell formed from a plurality of perforations or an outer ring;

the ball further comprises a core, the core is located inside of the shell or outer ring, and wherein the core is liberated from the shell after the ball breaks into the three or more pieces, or wherein the core breaks away from the outer ring when a pressure is applied to the ball to create the three or more pieces; and wherein the core performs a second wellbore operation, and the core is breakable into two or more parts to be flowed from the wellbore;

wherein the first wellbore operation corresponds to a first zone in the wellbore and the second wellbore operation corresponds to a second zone in the wellbore;

wherein the operations include tripping a sleeve of a sliding sleeve assembly and creating a wellbore interval;

wherein the core comprises a hollow core;

wherein the pattern comprises groupings of shapes selected from a group consisting of circular, elliptical, square, rectangular, triangular, and polygonal.

2. The method according to claim 1, wherein the shell breaks into the three or more pieces when a pressure is applied to the ball.

3. The method according to claim 2, wherein the shape of the three or more pieces are selected from the group consisting of circular, elliptical, square, rectangular, triangular, and polygonal.

4. The method according to claim 2, wherein the perforations are designed such that the three or more pieces have a desired cross-sectional area after the shell breaks apart.

5. The method according to claim 2, wherein the shell is made from metals and metal alloys, composites, phenolics, plastics, or wood.

6. The method according to claim 5, wherein the material making up the shell and the thickness of the shell are selected such that the ball has a desired density.

7. The method according to claim 6, wherein the desired density is a density greater than or equal to the density of a wellbore fluid used to introduce the ball into the wellbore.

8. The method according to claim 1, wherein the core performs the second wellbore operation, and wherein the second wellbore operation is shifting a sliding sleeve.

9. The method according to claim 1, wherein the outer ring is a solid ring or a ring of whickers encircling the core at a hemisphere of the core.

10. The method according to claim 1, wherein the first wellbore operation is selected from creating a wellbore interval or sifting a sliding sleeve.

11. A ball for performing a first wellbore operation comprising:

(a) a core; and (b) (i) a shell having a pattern on a surface of the shell formed from a plurality of perforations, wherein the shell breaks into three or more pieces when a pressure is applied to the ball and wherein the core is located inside of the shell; or (b) (ii) an outer ring connected to the core, wherein the core breaks away from the outer ring when a pressure is applied to the ball;

wherein the core is suitable for performing a second wellbore operation and is breakable into two or more parts to be flowed from the wellbore;

wherein each wellbore operation corresponds to a different zone in the wellbore;

wherein the operations include tripping a sleeve of a sliding sleeve assembly and creating a wellbore interval;

wherein the core is hollow;

wherein the pattern comprises groupings of shapes selected from a group consisting of circular, elliptical, square, rectangular, triangular, and polygonal.

12. The ball according to claim 11, wherein the shape of the three or more pieces are selected from the group consisting of circular, elliptical, square, rectangular, triangular, and polygonal.

13. The ball according to claim 11, wherein the perforations are designed such that the three or more pieces have a desired cross-sectional area after the shell breaks apart.

14. The ball of claim 11, wherein the second wellbore operation comprises shifting a sliding sleeve.

15. The ball according to claim 11 wherein each protrusion is connected to the core by at least one of spot-welding, adhesives, and mechanical fasteners.

16. The ball according to claim 15 wherein each protrusion is connected to the core by at least one of machining and molding actions.

17. A ball for wellbore operations comprising:

a core; and an outer ring connected to the core, wherein the core breaks away from the outer ring when a pressure is applied to the ball and the core is breakable to be flowed from a wellbore;

wherein the outer ring comprises a plurality of finger-like protrusions encircling the core along a hemisphere of the core.

18. The ball according to claim 17, wherein the core comprises a composite material, a phenolic material, a plastic material or a wood material, and is breakable under pressure.

19. A system for use in a wellbore that penetrates a subterranean formation, the system comprising:

a wellbore; and a ball, wherein the ball performs a first wellbore operation, and wherein the ball breaks apart into three or more pieces when a pressure is applied to the ball, wherein the ball comprises:

a) a core; and (b) (i) a shell having a pattern on a surface of the shell formed from a plurality of perforations, wherein the shell breaks into three or more pieces when a pressure is applied to the ball and wherein the core is located inside of the shell; or (b) (ii) an outer ring connected to the core, wherein the core breaks away from the outer ring when a pressure is applied to the ball;

wherein the core is suitable for performing a second wellbore operation including shifting a sliding sleeve;

wherein the first wellbore operation corresponds to a first zone in the wellbore and the second wellbore operation corresponds to a second zone in the wellbore;

wherein the operations are at least one of tripping a sleeve of a sliding sleeve assembly and creating a wellbore interval;

wherein the core is hollow;

wherein the pattern comprises groupings of shapes selected from a group consisting of circular, elliptical, square, rectangular, triangular, and polygonal.

20. The system according to claim 19, wherein the pressure is predetermined.

21. The system according to claim 20, wherein the predetermined pressure is a pressure that is greater than an operational pressure that is used to perform an operation prior to breaking of the ball.

22. The system according to claim 20, wherein the predetermined pressure is a pressure that is less than an operational pressure that is used to perform an operation after the breaking of the ball.

23. The system of claim 19, wherein the core is hollow and is breakable into two or more parts to be flowed from the wellbore.

* * * * *